US006858824B1

(12) United States Patent
Monteleone et al.

(10) Patent No.: US 6,858,824 B1
(45) Date of Patent: Feb. 22, 2005

(54) MICROWAVE HEATING SYSTEM TO PROVIDE RADIATION HEAT AND DOMESTIC HOT WATER

(76) Inventors: Alfred Monteleone, 189 Rabbit Run Rd., Clintondale, NY (US) 12515-5008; Brian Weit, 75 Long Rung Rd., Rhinebeck, NY (US) 12572

( * ) Notice: Subject to any disclaimer, the term of this patent is extended or adjusted under 35 U.S.C. 154(b) by 0 days.

(21) Appl. No.: 10/748,994

(22) Filed: Dec. 29, 2003

(51) Int. Cl.[7] ..... H05B 6/80

(52) U.S. Cl. ..... 219/688; 219/710; 219/717; 219/756; 219/761

(58) Field of Search ..... 219/688, 687, 219/710, 702, 715–717, 756, 757, 681, 761, 737–738

(56) References Cited

U.S. PATENT DOCUMENTS

| | | | | |
|---|---|---|---|---|
| 3,891,817 A | | 6/1975 | Brown | |
| 4,114,011 A | * | 9/1978 | Stubbs | 219/688 |
| 4,284,869 A | | 8/1981 | Pinkstaff | |
| 4,310,738 A | | 1/1982 | Moretti et al. | |
| 4,358,652 A | | 11/1982 | Kaarup | |
| 4,417,116 A | | 11/1983 | Black | |
| 4,593,169 A | | 6/1986 | Thomas | |
| 4,940,885 A | | 7/1990 | Challenger | |
| 4,956,534 A | | 9/1990 | Martin | |
| 5,179,259 A | * | 1/1993 | Martin | 219/688 |
| 5,296,666 A | * | 3/1994 | Varadan et al. | 219/696 |
| 5,519,196 A | | 5/1996 | Xu | |
| 6,043,474 A | | 3/2000 | Gates et al. | |
| 6,064,047 A | * | 5/2000 | Izzo | 219/688 |

FOREIGN PATENT DOCUMENTS

| | | | | |
|---|---|---|---|---|
| DE | 31 43 808 | * | 5/1983 | 219/688 |
| DE | 36 39 717 | * | 6/1988 | 219/688 |

* cited by examiner

*Primary Examiner*—Philip H. Leung

(57) ABSTRACT

A microwave heating system is provided which uses a heat conductive medium. The heat conductive medium is heated in a heater. The heater includes a shell which forms an enclosure. The enclosure has an upper end and a lower end. A heating coil is located in the enclosure. The heating coil has an upper end and a lower end and has an inverted frusto-conical shape. The upper end of the heating coil is larger than the lower end. Three magnetrons are mounted adjacent the heating coil. One magnetron is located at the upper end of the heating coil and the other two magnetrons are located on opposite sides of the heating coil for directing microwave energy into the heating coil. An electrical distribution system is connected to the magnetron. A return line supplies the heat conductive medium into the heating coil adjacent the lower end of the shell. The heat conductive medium is fed through a feed line to a storage tank and into a two-stage domestic hot water heater. The heat conductive medium then flows back to the hater through the return line. A circulator is located in the return line.

16 Claims, 7 Drawing Sheets

MICROWAVE HEATING SYSTEM TO PROVIDE RADIATION HEAT AND DOMESTIC HOT WATER

BACKGROUND OF THE INVENTION

1. Field of the Invention

This invention relates to heating systems and more specifically to a heating system using microwave energy as a source of heat.

2. Prior Art

Heating Systems using microwave energy produced by a magnetron are known. The Moreti patent, U.S. Pat. No. 4,310,738 teaches a heating furnace to heat a fluid. The use of an insulated chamber with a circuitous flow path and a magnetron are taught. A system for heating both domestic hot water and heating a building are not taught.

The Pinkstaff patent, U.S. Pat. No. 4,284,869 describes a hot water heater using three magnetrons. The water progresses from the bottom of a tank to the top of the tank. The tank is divided into three sections. In each section the domestic hot water is heated to a still higher temperature. Pinkstaff describes the direct heating of the domestic hot water but does not pertain to a system that heats a building or a two-stage domestic hot water heater.

The Brown patent, U.S. Pat. No. 3,891,817, teaches a system for heating a building using microwave heat. The Brown patent teaches the direct heating of a fluid and not the use of both a primary fluid to heat a secondary fluid. According to the Brown patent, the heated fluild passes by means of a pump from a container where it is heated to a tank. From the tank the fluid passes to a heat exchanger. A bypass permits the fluid returning from the heat exchanger to return to the tank and bypass the container and the microwave heat source. The bypass is controlled by a temperature container and the microwave heat source. The bypass is controlled by a temperature sensor in the tank.

Microwave energy produces economical and energy saving heat. A system which uses microwave energy to provide domestic hot water as well as heat ro a building to provide a heating system that is energy conserving and economical. The use of a medium, which is a heat conductive fluid, increases the efficiency of the system but can cause concerns about the contamination.

OBJECTS

Accordingly, the objects of the invention are as follows:

1. To provide a heating system using microwave energy that provides both domestic hot water and a heating system such as base board radiation.
2. To provide a heating system that protects the domestic hot water from contamination.
3. To provide a heating system using microwave energy that is both economical and dependable.

SUMMARY OF THE INVENTION

A microwave heating system is provided which uses a heat conductive medium. The heat conductive medium is heated in a heater. The heater includes a shell which forms an enclosure. The enclosure has an upper end and a lower end. A heating coil is located in the enclosure. The heating coil has an upper end and a lower end and has an inverted frusto-conical shape. The upper end of the heating coil is larger than the lower end. Three magnetrons are mounted adjacent the heating coil. One magnetron is located at the upper end of the heating coil and the other two magnetrons are located on opposite sides of the heating coil for directing microwave energy into the heating coil. An electrical distribution system is connected to the magnetron. A return line supplies the heat conductive medium into the heating coil adjacent the lower end of the shell. A line means is connected to the heating coil toward the upper end of the enclosure and extending outside the shell. The line means has two branches. The Microwave Heating System also includes a domestic hot water heater including a first heat exhanger and a second heat exhanger. The first heat exhanger is connected to one of the branches of the line means. A water coil is located in the second heat exchanger. The first heat exchanger is also connected to the return line. A water coil is located in the second heat exchanger. Heat exchanger means are connected to the line means to receive heat conductive medium and are connected to the return line. A circulator is located in the return line.

DESCRIPTION OF THE NUMERALS

| NUMERAL | DESCRIPTION |
|---|---|
| 11 | Heater |
| 13 | Shell |
| 14 | Enclosure |
| 15 | Heating Coil |
| 16 | Upper End (Heating Coil) |
| 17 | Lower End (Heating Coil) |
| 18 | Insulation |
| 19 | Magnetrons |
| 21 | First Magnetron |
| 23 | Two Other Magnetrons |
| 24 | Microwave Leak Detector |
| 25 | Power Supply |
| 26 | Main Switch |
| 27 | Distribution Power System |
| 28 | Thermal Switch |
| 29 | Air Intake Fan |
| 30 | Three Conduits |
| 31 | Ducts |
| 32 | Two Return Conduits |
| 33 | Exhaust Port |
| 34 | Barrier |
| 35 | Mounting Stand |
| 36 | Supports |
| 37 | Base or Lower End of Shell |
| 39 | Drip Pan |
| 41 | Pressure Relief Valve |
| 43 | Top or Upper End of Shell |
| 45 | Return Line |
| 47 | Circulator or Pump |
| 49 | Bleeder Valve |
| 51 | Medium Outlet |
| 53 | Feed Line |
| 55 | Storage Tank |
| 57 | Domestic Hot Water Heater |
| 59 | Lower End (Storage Tank) |
| 61 | Top or Upper End (Storage Tank) |
| 63 | Pressure Relief Valve |
| 65 | Thermostat Control (Storage Tank) |
| 67 | Supply Line |
| 69 | Separate Branch |
| 73 | First heat Exchanger |
| 75 | Second heat Exchanger |
| 77 | First Enclosure |
| 79 | Medium Side |
| 81 | Water Side |
| 82 | Lower End |
| 83 | Medium Tube or Tubes |
| 84 | Upper End |
| 85 | Water Coil |
| 86 | Water Tube or Tubes |
| 87 | Fins |

-continued

DESCRIPTION OF THE NUMERALS

| NUMERAL | DESCRIPTION |
|---|---|
| 89 | Second Enclosure |
| 91 | Water Supply |
| 93 | Domestic Hot Water Line |
| 95 | Thermostat (Domestic Hot Water Heater) |
| 97 | Heating Lines |
| 99 | Radiation |
| 101 | Thermostat or Thermostats |
| 103 | First unit of Radiation |
| 105 | Second Unit of Radiation |
| 107 | Third Unit of Radiation |
| 109 | Circulator or Pump |
| 111 | Make-up or Medium Tank |
| 113 | Storage Line |
| 115 | Volume Sensor Switch and Gate Valve |
| 119 | Tank Pressure Valve |
| 121 | Pressure Gauge |
| 123 | Filler Cap |

DETAILED DESCRIPTION OF THE PREFERRED EMBODIMENT

Figure 1:
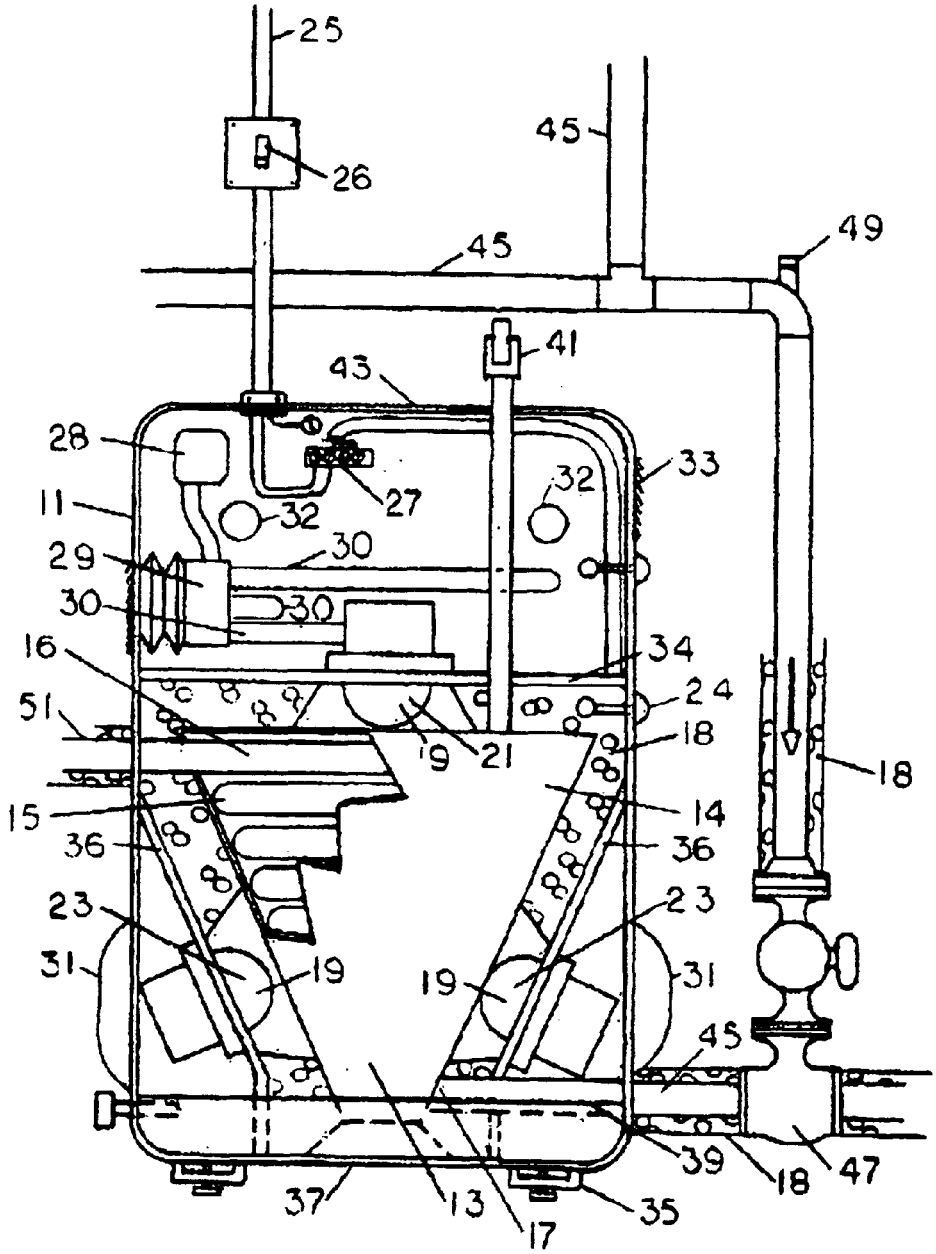
FIG. 1 is a cross-sectional view of a microwave heater showing the heating coil with three magnetrons and the input and the output of the heat conductive medium.

Referring now to FIG. 1, the heater 11 can be seen. The heater 11 is encased within a shell 13 which forms an enclosure 14. In the lower half of the shell 13, there is a heating coil 15 with the configuration of an inverted frustum. The heating coil 15 has an upper end 16 and a lower end 17 and is surrounded by insulation 18.

There are three magnetrons 19 which supply microwave energy into the heating coil 15. The first magnetron 21 is centrally located directly above the heating coil 15 and is further located at the upper end 16 of the heating coil 15. The upper end 16 of the heating coil 15 has a larger diameter than the lower end 17 of the heating coil 15 which has a smaller diameter. The two other magnetrons 23 are located on the sides of the heating coil 15 and are angled at the same pitch as the heating coil 15. A microwave leak detector 24 is located on the side of the shell 13 above the heating coil 15.

A power supply 25 is located outside the shell 13, preferably above the shell 13, to supply electrical energy to the three magnetrons 19 through a main switch 26 to a power distribution system 27 located in the enclosure 14 above the heating coil 15. A thermal switch 28 is connected to the power supply 25 by the power distribution system 27. The thermal switch 28 activates an air intake fan 29 to cool the magnetrons 19. Three Conduits 30 to the first magnetron 21 and to two ducts 31 located by the two other magnetrons 23. Two conduits 32 take the cooling air from the ducts 31 back into the enclosure 14. All of the air forced into the enclosure 14 by the air intake fan 29 exits the enclosure 14 through an exhaust port 33. The air which is blown across the magnetrons 19 by the air intake fan 31 is exhausted through an exhaust port 33 on the opposite side of the shell 13 from the air intake fan 31. The shell 13 is divided by a barrier 34, with the heating coil 15 beneath the barrier 34 and the power distribution system 27 above the barrier 34. The microwave lek detector 24 is located beneath the barrier 34.

The heating coil 15 is mounted on a mounting stand 35 which rests on the base or lower end 37 of the shell 13. Supports 36 hold the two other magnetrons 23. Just above and covering the base or lower end 37 of the shell 13 is a drip pan 39 to retain any heat conductive medium leaks from the heating coil 15. A pressure relief valve 41 is connected to the upper end 16 of the heating coil 15 and extends from the heating coil 15 out of the shell 13 at the top or upper end 43 of the shell 13. The pressure relief valve 41 assures the release of dangerous pressure if for any reason, pressure builds up in the heating coil 15. The upper end 43 and the lower end 37 of the shell 13 are also the upper end 43 and the lower end 37 of the enclosure 14.

The heat conductive medium pumped is into the heating coil 15 at its lower end 17. The heat conductive medium is fed into the heating coil 15 through a return line 45. The return line 45 is also covered with insulation 18. A circulator or pump 47 in the return line 45 forces the heat conductive medium into the heating coil 15. The return line 45 has a bleeder valve 49 to relieve air pockets that form in the return line 45.

The heat conductive medium pumped into the heating coil 15 is heated by the microwave energy produced by the three magnetrons 19. After the heat conductive medium passes through the heating coil 15, it then exits the shell 13 through a medium outlet 51.

Figure 2:
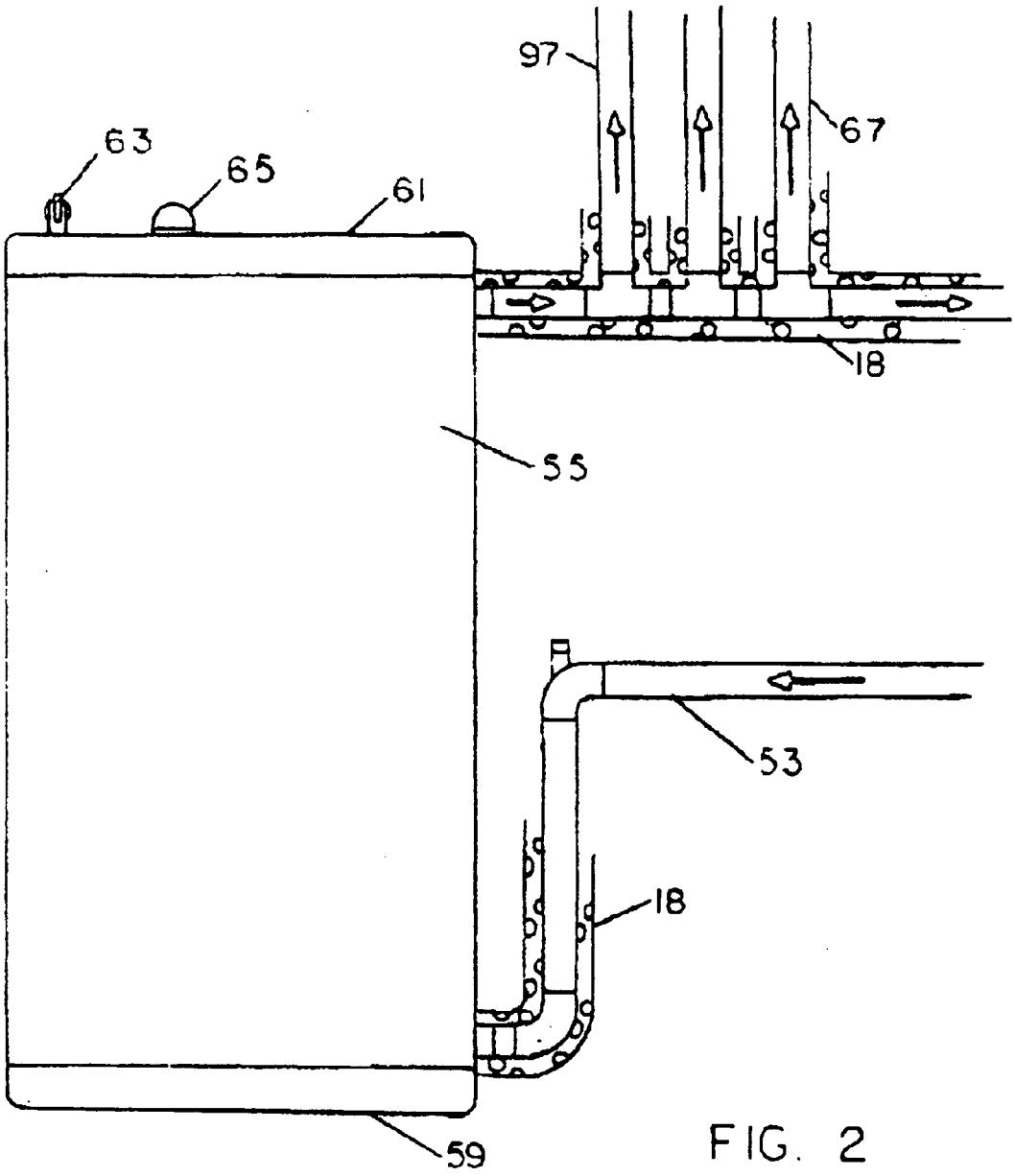
FIG. 2 is a side elevation of a storage tank for heat conductive medium that has been heated showing the path of flow of the heat conductive medium into the storage tank and out of the storage tank with heating lines from the return line.

Referring now to FIG. 2, the heat conductive medium, following its increase in temperature in the heating coil 15, passes into a feed line 53. The feed line 53, which is also covered with insulation 18, connects the heating coil 15 to a storage tank 55. The feed line 53 branches off to supply heat conductive medium to a domestic hot water heater 57 which will be subsequently described. The heat conductive medium is fed into the storage tank 55 at its lower end 59 and exits the storage tank 55 at the top 61 of the storage tank 55. At the top 61 of the storage tank 55, there is a pressure relief valve 63 and a thermostat control 65 which is normally set at one hundred eighty degrees Fahrenheit, which is the desired temperature for the heat conductive medium. Should the temperature of the heat conductive medium drop below the desired temperature, the thermostat control 65 increases the output of the three magnetrons 19. Should the temperature of the heat conductive medium exceed the desired temperature, the thermostat control 65 will switch the magnetrons 19 to the off position thereby eliminating all microwave input from the magnetrons 19 to the heating coil 15. The heat conductive medium leaves the storage tank 55 through a supply line 67.

Figure 4:
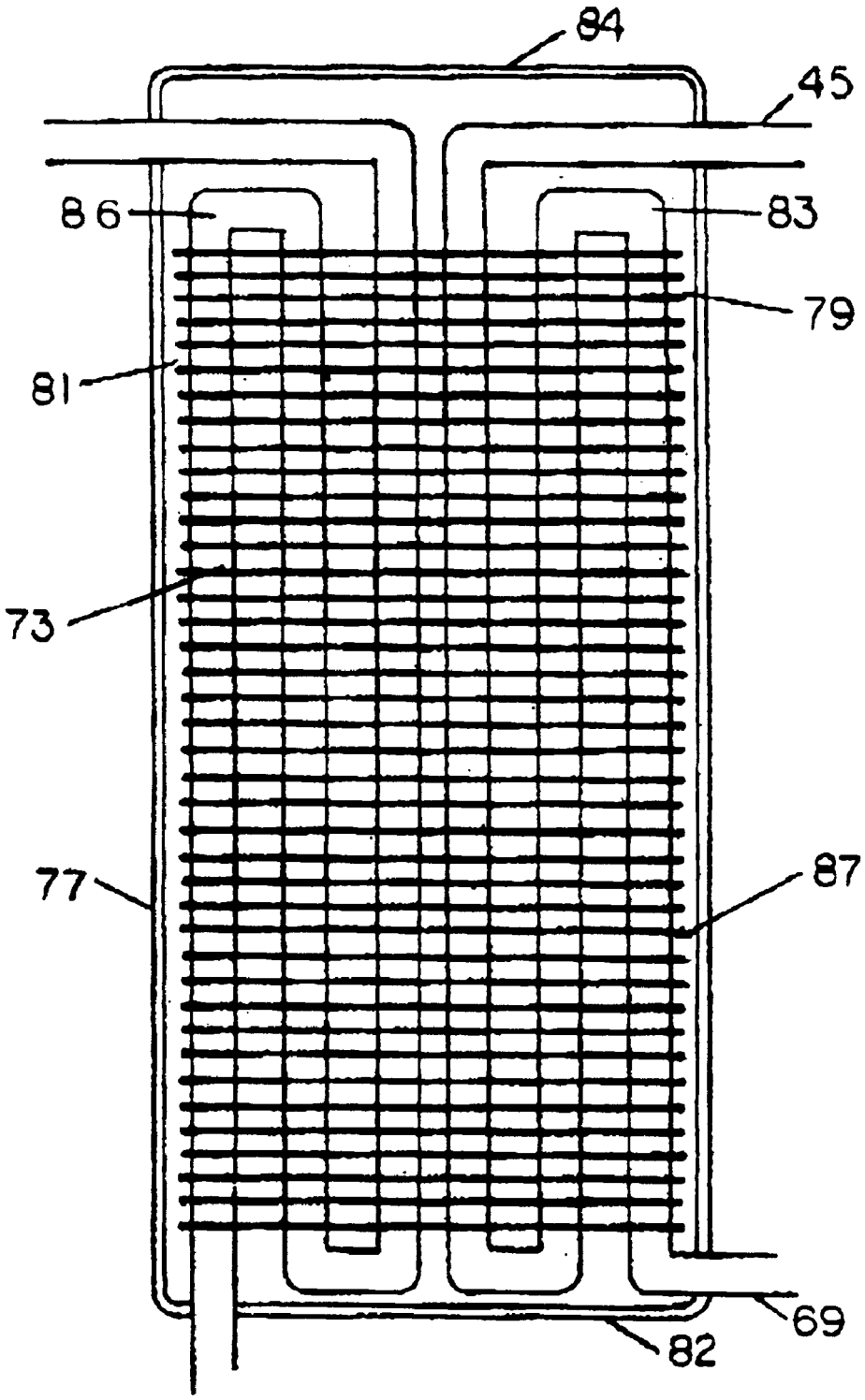
FIG. 4 is a sectional view of the first stage of the two stage domestic hot water heater shown in FIG. 3.
Figure 6:
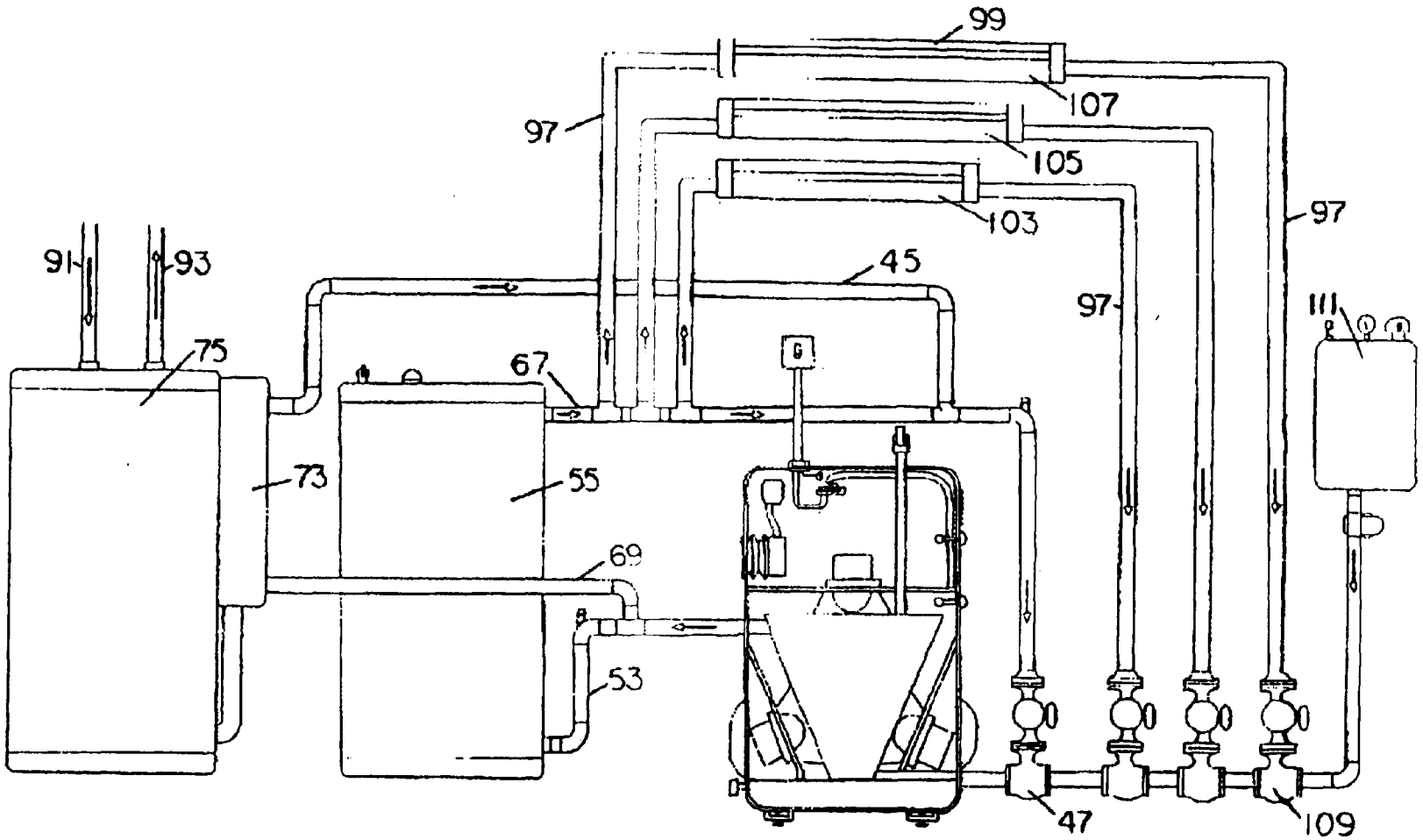
FIG. 6 is a schematic diagram of the flow of the heat conductive medium microwave heat system through the units shown in FIG. 1 through FIG. 5 connected together.

As previously stated, a separate branch 69 (FIG. 6) of the feed line 53 supplies heat conductive medium to the domestic hot water heater 57 which is formed from a first heat exchanger 73 and a second heat exchanger 75. The first heat exchanger 73 of the domestic hot water heater 57 is designed to prevent contamination from the heat conductive medium to the domestic hot water produced in the domestic hot water heater 57. The first heat exchanger 73 is shown in FIG. 4. The first heat exchanger 73 has a first enclosure 77 and has a medium side 79 and a water side 81. The heat conductive medium is fed into the lower end 82 of the medium side 79 of the first enclosure 77. The heat conductive medium passes through at least one median tube 83 and then exits the medium side 79 of the first heat exchanger 73 near the upper end 84 of the of the medium side 79 of the first heat exchanger 73.

Water is fed into the water side 81 of the first heat exchanger 73 (FIG. 4) near the lower end 82 of the first enclosure 77 and flows upwardly through the water side 81 of the first heat exchanger 73 and exits the first enclosure 77 near the upper end 84 of the first enclosure 77. The water then enters a water coil 85 in the second heat exchanger 75. At least one water tube 86 is located in the water side 81 of the first heat exchanger 73 through which the water flows to the water coil 85. A multiplicity of fins 87 are mounted horizontally across the water tube 86 and the medium tube 83 in the first heat exchanger. The heat from the heat conductive medium heats the fins 87 and the fins 87 heat the water passing through the water tube 86 on the water side 81 of the first heat exchanger 73. The water passes from the water coil 85 back to the water tubes 86 in the first heat exchanger 73 and thus forms a closed loop.

Figure 3:
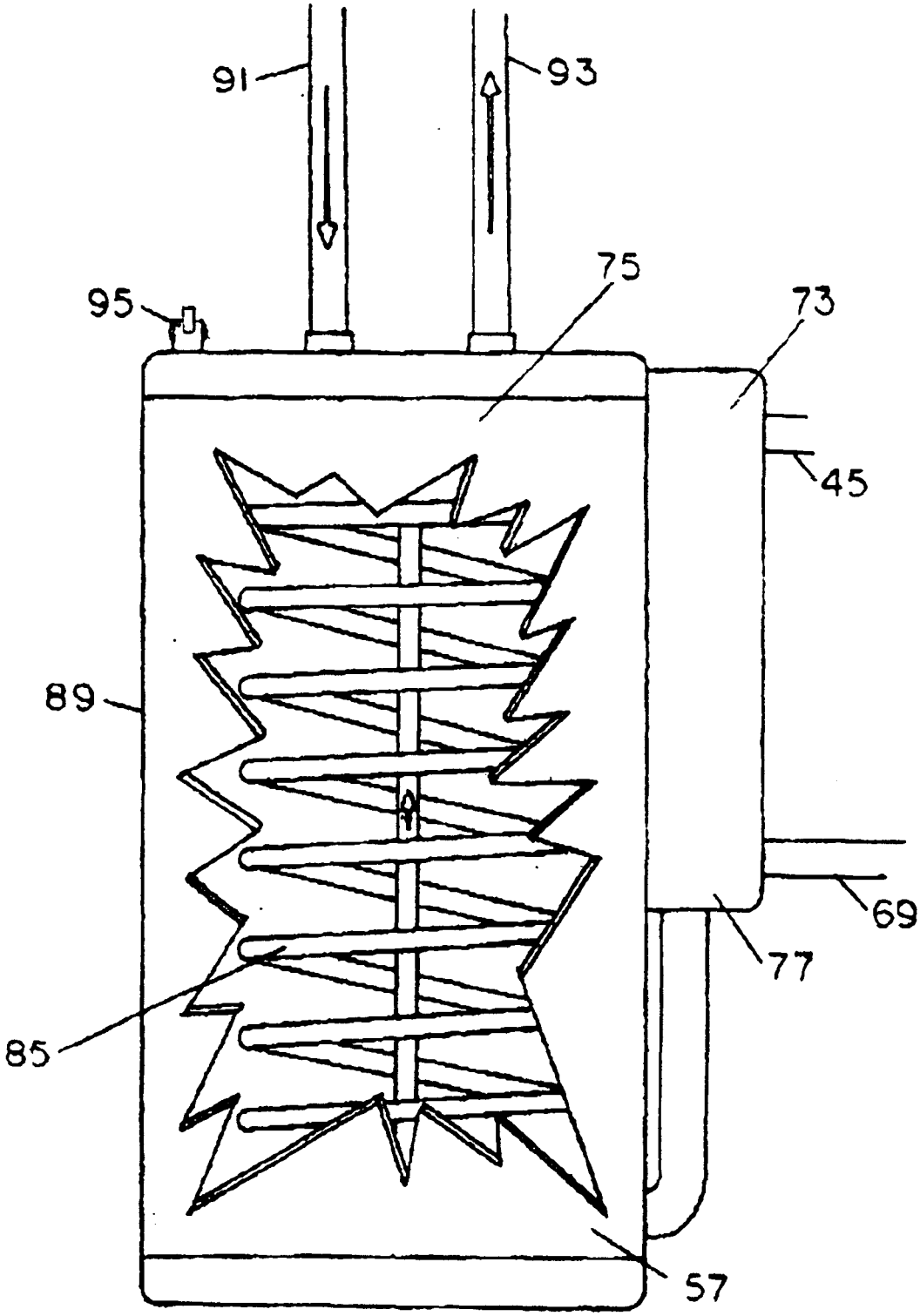
FIG. 3 is a side elevation showing a two-stage domestic hot water heater with the second stage partially broken away to show the water coil.

The second heat exchanger 75 (FIG. 3) has a second enclosure 89 which is separate from the first heat exchanger 73. Therefore, a leak of heat conductive medium in the first heat exchanger 73 cannot enter the domestic hot water in the second heat exchanger 75. Cold water from a water supply 91 is fed into the second stage heat exchanger 75 and is then heated by the water coil 85. Heated water from the second heat exchanger 75 is fed into the domestic hot water line 93 of the building being so supplied.

The heat conductive medium leaving the first heat exchanger 73 (FIG. 6) rejoins the heat conductive medium leaving the storage tank 55 and enters the return line 45. Heating lines 97 supply heat conductive medium into radiation 99, most likely base board radiation. Thermostats 101 in the heated area control the operation of the separate units of radiation 99. Three units of radiation 99 are shown, namely a first unit of radiation 103, a second unit of radiation 105 and a third unit of radiation 107. Heat conductive medium flows through each of the units of radiation 99 through the heating lines 97 into the first unit of radiation 103, the second unit of radiation 105 and the third unit of radiation 107 and then connects to a circulator or pump 109, as dictated by the respective thermostat 101, and is then fed via the circulator or pump 109 and is forced by the circulator back into the heating coil 75 in the heater 11 where the heating of the heat conductive medium begins again. With the three units of radiation 99, there are three circulators or pumps 109, each forcing the heat conductive medium from its unit of radiation 99 back into the heating coil 15 of the heater 11. The return line 45 is, as previously stated, connected to its own circulator or pump 47. In this way, the heat conductive medium can flow through any one unit of radiation 99 or the domestic hot water heater 57 or any combination thereof whenever demand may occur.

Figure 5:
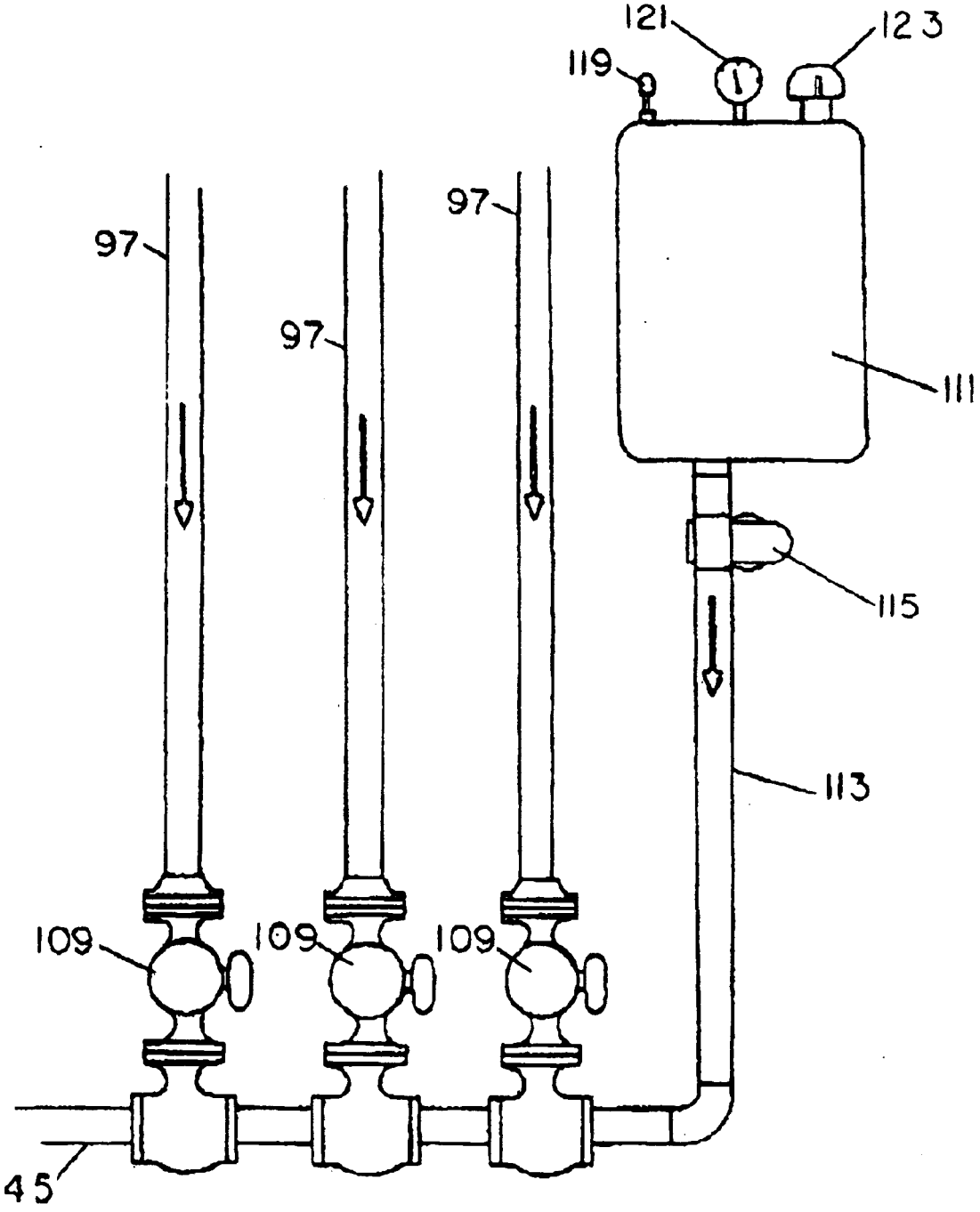
FIG. 5 is a front elevation showing the heater lines with circulators connected to the return line and also showing the medium tank.

As seen in FIG. 5, the return line 45 also includes a medium or make-up tank 111 for the heat conductive medium. The heat conductive medium is fed from the make-up tank 111 into the return line 45 by a storage line 113 from the make-up tank 111 to the return line 45. The make-up tank 111 holds almost three gallons of heat conductive medium. In the storage line 113 there is a volume sensor switch and gate valve 115. The volume sensor switch and gate valve 115 determines the need for make up heat conductive material and the volume sensor switch and gate valve 115 opens to permit the flow of the heat conductive medium into the return line 45. On the top of the make-up tank 111, a tank pressure valve 119 is located to permit, by means of compressed air, an increase in the pressure in the make-up tank 111. Sufficient pressure is required in the make-up tank 111 to assure that the conductive medium from the make-up tank 111 will enter the return line 45. The make-up tank 111 also has a pressure gauge 121 and a filler cap 123. Despite the inclusion of the make-up tank 111, it is estimated that the need for heat conductive medium to be supplied from the make-up tank 111 would be limited to about a cup a year.

Figure 7:
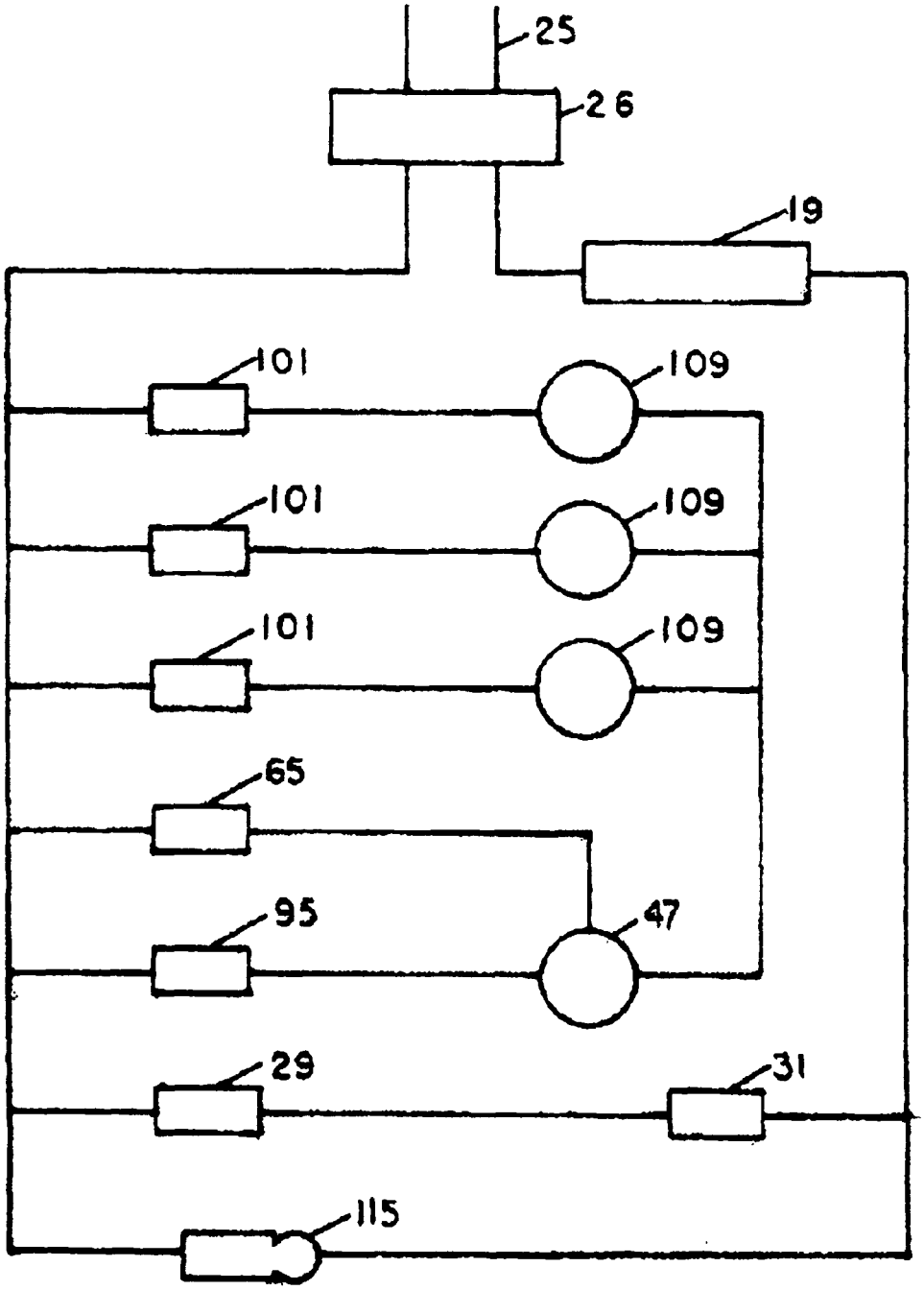
FIG. 7 is a schematic electrical diagram of the controls for the heating system.

Referring now to FIG. 7, the electrical diagram for the microwave heating system can be seen. The power supply passes through a main switch 26 into the distribution power system 27. Three thermostats 101 are shown and each one of which activates both its respective circulator 109 and all three magnetrons 19. Only one or more circulators 109 may be activated at the same time and only one or more may be used. A thermostat 65 in the storage tank 55 turns on the circulator 47 in the return line 45 as does the thermostat 95 in the domestic hot water heater 57. Sensor Switch and Gate Valve 115 opens the storage line 113 but does not activate the magnetrons 19.

The heat conductive medium can be any number of different materials. Ethylene glycol is one well-known heat conductive medium. However, a preferred heat conductive material is palm oil and fatty acids. Teflon can be used for the tubing in the heater but polypropylene is a preferable as it achieves greater heat exchange.

It is understood that the drawings and the descriptive matter are in all cases to be interpreted as merely illustrative of the principles of the invention, rather than as limiting the same in any way, since it is contemplated that various changes may be made in various elements to achieve like results without departing from the spirit or the invention of the appended claims.

What is claimed is:

1. A microwave heating system using a heat conductive medium comprising:

a heater including:

a shell forming an enclosure having an upper end and a lower end;

a heating coil located in the enclosure, the heater coil having an upper end and a lower end and having an inverted frusto-conical shape, the upper end of the coil being larger than the lower end;

three magnetrons mounted adjacent the heating coil, one magnetron being located at the upper end of the heating coil and the other two magnetrons being located on opposite sides of the heating coil for directing microwave energy into the heating coil;

an electrical distribution system connected to the magnetron;

an electrical distribution system connected to the magnetron;

a return line for supplying the heat conductive medium into the heater coil adjacent the lower end of the shell;

a line means connected to the heating coil toward the upper end of the enclosure and extending outside the shell, the line means having two branches;

a domestic hot water water heater including:

a first heat exchanger, at least one medium tube located in the first heat exhancer, one branch of the line means being connected to the medium tube and the medium tube also being connected to the return line, at least one water tube located in the first heat exchanger, a plurality of fins extending across both the medium tube and the water tube to conduct heat from the medium tube to the water tube, a second heat exchanger, a water coil located in the second heat exchanger, the water tube being connected to the water coil at both ends; and heat exchanger means connected to the other branch of line means to receive heat conductive medium and being connected to the return line; and a circulator located in the return line.

2. A heating system according to claim 1 wherein the heater further includes a leak detector for detecting the presence of heat conducting medium, the leak detector being located at the lower end of the shell.

3. A heating system according to claim 1 wherein the heater further includes a drip pan located at the lower end of the shell.

4. A heating system according to claim 1 wherein the heater further includes insulation within the enclosure about the heating coil ane the magnetrons.

5. A heating system according to claim 1 further including a microwave leak detector located in the shell above the upper end of the heating coil for detecting the presence of microwave energy outside of the heating coil.

6. A heating system according to claim 1 further including an air intake fan located toward the upper end of the shell for blowing air into the enclosure and an air exhaust port also located toward the upper end of the shell.

7. A microwave heating system using a heat conductive medium comprising:

a heater including;

a shell forming an enclosure and having an upper end and a lower end, a heating coil located inside the shell, at least one magnetron for directing microwave energy into the heating coil, an electrical distribution system connected to the magnetron, a return line for supplying the heat conductive medium into the heating coil adjacent the lower end of the shell;

a feed line connected to the heating coil toward the upper end of the shell and extending outside the shell;

a supply line; and means for connecting the feed line to the supply line, the supply line having two branches, one branch being connected to the return line;

a domestic hot water heater including:

a first heat exchanger having two ends, at least one medium tube located inside the first heat exhanger, the other branch of the supply line being connected to the medium tube at one end of the first heat exchanger, the return line being connected to the medium tube at the other end of the first heat exchanger, at least one water tube located in the first heat exchanger, a plurality of fins extending across both the medium tube and the water tube to conduct heat from the medium tube to the water tube, a second heat exchanger having two ends, a water coil located in the second heat exchanger, having two ends, the water tube being connected to the water coil at both ends; and heater lines connected to the return line to convey heat conductive medium for heating purposes from the return line and back to the return line; and at least one circulator located in the return line.

8. A heating system according to claim 7 wherein the heater further includes a leak detector for detecting the presence of heat conducting medium, the leak detector being located at the lower end of the shell.

9. A heating system according to claim 7 wherein the heater further includes a drip pan located at the lower end of the shell.

10. A heating system according to claim 7 wherein the heater further includes insulation within the enclosure about the heating coil and the magnetron.

11. A heating system according to claim 7 further including a microwave leak detector located in the shell above the heating coil for detecting the presence of microwave energy outside of the heating coil.

12. A heating system according to claim 7 further including an air intake fan located toward the upper end of the shell for blowing air into the enclosure and an air exhaust port also located toward the upper end of the shell.

13. A microwave heating system according to claim 7 wherein the heating coil has an upper end and a lower end and wherein the heating coil has an inverted frusto-conical shape, the upper end of the heating coil being larger than the lower end.

14. A microwave heater system using a heat conductive medium comprising:

a heater including:

a shell forming an enclosure and having an upper end and a lower end, a heating coil located toward the lower end of the enclosure, the heating coil having the shape of an inverted frustum, three magnetrons for directing microwave energy into the heating coil, one magnetron being located at the top of the heating coil and two other magnetrons being located at opposite sides of the heating coil;

a pressure relief valve extending from the heating coil through the shell, an electrical distribution system connected to the three magnetrons, a cooling fan for blowing air from outside the shell into the enclosure, an air outlet for discharging air from within the enclosure to outside the shell, insulation located inside the shell and about the heating coil, a leak detector extending from inside the shell to the outside and being located toward the lower end of the enclosure to detect leaks of the heat conductive medium;

a return line for supplying the heat conductive medium into the heating coil adjacent the lower end of the shell;

a feed line connected to the heating coil toward the upper end of the shell and extending outside the shell;

a storage tank having an upper end and a lower end for the storage of heat conductive medium, the feed line being connected to the storage tank adjacent the lower end of the tank;

a supply line connected to the upper end of the storage tank, the supply line having two branches, one branch being connected to the return line;

a domestic hot water heater, the other branch of the supply line being connected to the domestic hot water heater, the domestic hot water being connected to the return line;

at least one heater line connected to the return line to convey heat conductive medium for heating purposes from the return line and back to the return line; and circulator located adjacent the heater in the return line and in the heater line.

15. A microwave Heating System according to claim 14 wherein the domestic hot water heater further includes:

a first heat exchanger having an upper end and a lower end;

at least one medium tube located inside the first heat exchanger;

the other branch of the supply line being connected to the domestic hot water heater at the medium tube in the lower end of the first heat exchanger, the domestic hot water heater being connected to the return line at the medium tube at the upper end of the first heat exchanger;

a water tube located in the first heat exchanger;

a plurality of fins extending along both the medium tube and the water tube to conduct heat from the medium tube to the water tube;

a second heat exchanger having an upper end and a lower end and having an inside, a water inlet and a water outlet located at the upper end of the second heat exchanger; and a water coil located in the second heat exchanger, the water coil in the second heat exchanger having an upper end and a lower end, the water tube being connected to the coil at both its upper end and its lower end.

16. A microwave heating system according to claim 14 further including:

a medium tank including a pressure gauge and a pressure filler valve;

a filler line connecting the medium storage tank to the return line; and a volume sensor switch and a gate valve located in the filler line.

* * * * *